United States Patent [19]

Fixon

[11] Patent Number: 5,025,948

[45] Date of Patent: Jun. 25, 1991

[54] SEALED PACKAGING BOX WITH MECHANICAL OR MANUAL VACUUM, FULL OR PARTIAL VACUUM

[76] Inventor: Georges Fixon, Chalet Prevert, Oberbort, CH 3780 Gstaadt, Switzerland

[21] Appl. No.: 536,006

[22] Filed: Jun. 8, 1990

[30] Foreign Application Priority Data

Jun. 13, 1989 [FR] France ..... 89 07810

[51] Int. Cl.[5] ..... B65D 51/16

[52] U.S. Cl. ..... 220/366; 220/360; 220/306; 220/204; 220/276

[58] Field of Search ..... 220/306, 204, 208, 209, 220/360, 366, 203, 355, 356, 276

[56] References Cited

U.S. PATENT DOCUMENTS

| | | | |
|---|---|---|---|
| 3,173,571 | 3/1965 | Cserny et al. | 220/208 |
| 3,353,708 | 11/1967 | Davis | 206/519 |
| 3,362,565 | 1/1968 | McCormick | 220/355 |
| 3,381,872 | 5/1966 | Holder et al. | 220/306 |
| 3,651,981 | 3/1972 | Kinney | 220/208 |
| 3,672,536 | 6/1972 | Kinney et al. | 220/307 |
| 4,669,630 | 6/1987 | Kenyon, II | 220/276 |

*Primary Examiner*—Stephen Marcus

*Assistant Examiner*—Stephen K. Cronin

*Attorney, Agent, or Firm*—Oblon, Spivak, McClelland, Maier & Neustadt

[57] ABSTRACT

Sealed packaging box consisting of a receptacle and a cover capping the latter, each comprising connecting means intended to work together to close the box in a sealed manner, box characterized in that:

the connecting means of receptacle (1) are formed by an edge of a reinforced packing ring (5) bordering the opening of receptacle (1), this ring (5) being penetrated by at least one passage (6) connecting the inside of receptacle (1) to the outside, passage (6) being flared (61) toward the inside of the receptacle, the connecting means of cover (2) comprise:

on bottom (21) and inside cover (2), an annular rib (22) intended to come behind packing ring (5), a peripheral outside edge (23) coming over the edge in the shape of a ring (5) of receptacle (1), a section and location sealing element (27) corresponding to flared part (61) of the passage of ring (5) to come into the latter and to seal it at least partially when cover (2) is mounted, peripheral outside edge (23) capping outside orifice (63) of passage (6).

8 Claims, 3 Drawing Sheets

SEALED PACKAGING BOX WITH MECHANICAL OR MANUAL VACUUM, FULL OR PARTIAL VACUUM

BACKGROUND OF THE INVENTION

1. Field of the Invention

This invention relates to a sealed packaging box consisting of a receptacle and a cover capping the latter, each comprising connecting means intended to work together to close the box in an airtight manner.

2. Description of the Prior Art

Numerous types of sealed boxes exist which are distinguished from one another by the connecting means between the cover and the receptacle. Some boxes are closed by inserting the cover to create a partial vacuum inside the box once closed, the cover returning elastically to its normal position.

Although these boxes are advantageous particularly for the temporary preservation of food products in a refrigerator or the like, such boxes, or at least their principle, are not suitable to receive some types of food products, in particular very fragile products.

SUMMARY OF THE INVENTION

This invention proposes to create a packaging box with tight closing, making it possible to create a partial vacuum inside the box at the time of its closing to expel from it at least part of the air found between the product placed in the box and the cover, and, on the other hand, to evacuate the excess liquids, a box that has an easy embodiment and a practical use particularly at the time of its first closing, and that can be reused.

For this purpose, the invention relates to a box of the above type, characterized in that:

the connecting means of the receptacle are formed by an edge made of a reinforced packing ring bordering the opening of the receptacle, this ring being penetrated by at least one passage connecting the inside of the receptacle to the outside, the passage being flared toward the inside of the receptacle.

The connecting means of the cover comprise:

on the bottom and inside of the cover, an annular rib intended to come behind the packing ring, a peripheral outside edge coming over the edge in the shape of a ring of the receptacle, a section and location sealing element corresponding to the flared part of the passage of the ring to come into the latter and to seal it at least partially when the cover is mounted, the peripheral outside edge capping the outside orifice of the passage.

According to another characteristic of the invention, the edge of the cover is provided with a safety strip ending in a tearing flap, this strip connected to the edge by a preferred breaking line is hooked under the edge of the receptacle.

According to another characteristic of the invention, the passage is open toward the upper edge of the receptacle.

According to another characteristic of the invention, the passage has a shape continuing to be flared toward the inside of the receptacle or only toward the outside, by two flared parts separated by a neck.

According to another characteristic of the invention, the inside flared part of the passage in the receptacle has a V-shaped section and the sealing element of the cover intended to lie in this flared part has a diamond-shaped section with or without lips.

According to another characteristic of the invention, the cover comprises a reinforcing and lifting rib.

According to another characteristic of the invention, the outside upper part of the ring of the receptacle is made by a conical surface to facilitate the mounting of the cover.

According to another characteristic of the invention, the inside annular rib of the cover has a rounded edge on the side working with the ring-shaped edge of the receptacle.

Thus, in summary, the box according to the invention makes it possible, thanks to its closing in two stages, to exert a certain pressure on the cover to evacuate the air and the excess liquids of the box through the passages, then by a simple movement of rotation (rotation which can be very slight) to position and to insert completely the cover and to keep it hooked there particularly in the case of the first closing, by the safety strip.

This box can be opened a first time after tearing the safety strip. It is possible to sample part of the contents of the box and, in this case, it can again be closed with the cover by proceeding in the same manner as at the time of the first closing except that in this case, there no longer will be a safety strip, which is unnecessary in most cases, the box being at the home of the user or the consumer.

Although this box is intended mainly to receive fragile food products such as, for example, caviar, spices, etc. . . , this box is not limited solely to use in the food industry. It also can be used in other industries for packaging and transporting fragile products that should be packaged safe from air or moisture.

BRIEF DESCRIPTION OF THE DRAWINGS

This invention will be described in a more detailed manner with the help of the accompanying drawings in which.

DESCRIPTION OF THE PREFERRED EMBODIMENTS

According to FIGS. 1 to 4, the invention relates to a sealed packaging box consisting of a receptacle (1) and a cover (2) connected to one another by connecting means that work together to close the packaging box in a sealed manner after having manually or mechanically expelled the air from it, the box being full to the brim or partially full.

Figure 1:
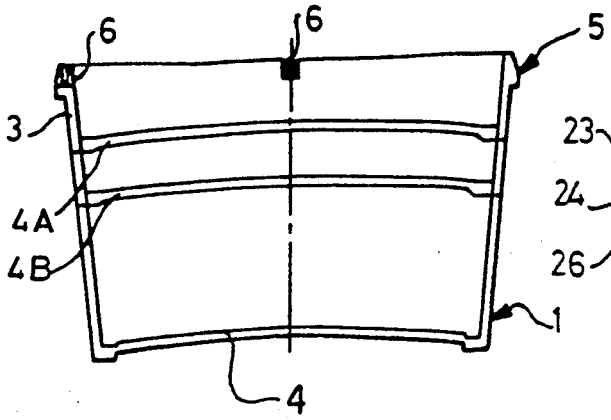
FIG. 1 is a view in section of a receptacle of a packaging box according to the invention.
Figure 2:
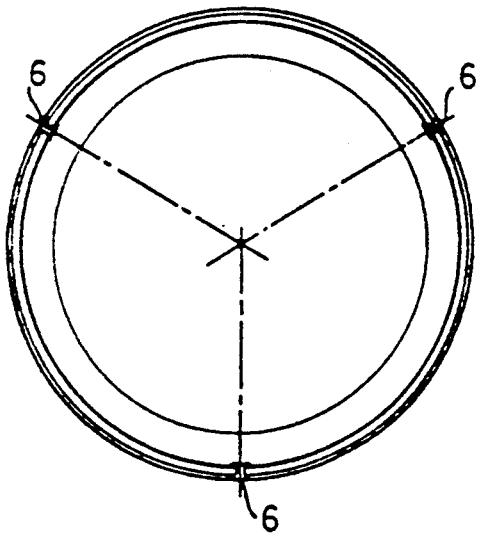
FIG. 2 is a top view of the receptacle of FIG. 1.

According to FIGS. 1 and 2, receptacle (1) consists, for example, of a tapered side wall (3) and a bottom (4). For a same wall (3), this bottom can be made with various heights (4A, 4B) according to the capacity of the receptacle. On the upper part, receptacle (1) is provided with a peripheral edge in the form of a packing ring (5) penetrated by passages (6) connecting the inside of the receptacle to the outside. According to the embodiment shown, passages (6) come out on the upper surface of ring (5).

Figure 3:
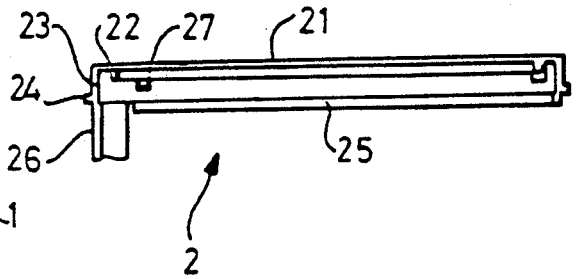
FIG. 3 is a view in section of the cover intended for the receptacle of FIG. 1.
Figure 4:
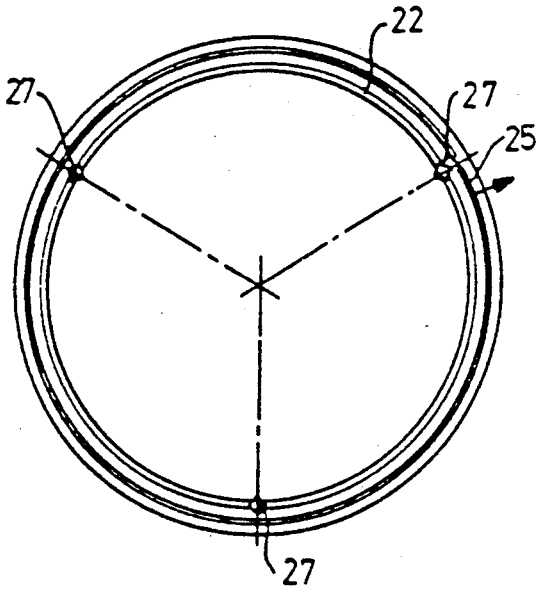
FIG. 4 is a bottom view of the cover of FIG. 3.
Figure 9:
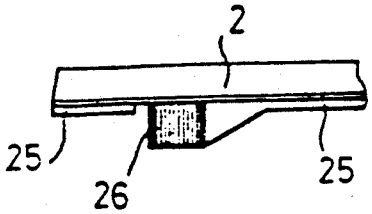
FIG. 9 is a side view showing the tearing tab of the safety strip.

According to FIGS. 3 and 4, cover (2), which caps receptacle (1), consists of a bottom (21) provided inside with a rib (22) and bordered by a peripheral outside edge (23) with, if necessary, a reinforcing rib (24) and, on the lower part, a safety strip (25) provided with a tearing flap (26) (see FIG. 9). On the level of rib (22), in positions selected as a function of the arrangement of the flared parts of passages (6), cover (2) comprises sealing elements or plugs (27) which, when cover (2) is placed on the receptacle, come to lie in the flared parts of passages (6) to seal them from the rear, the front face of passages (6) being sealed by peripheral edge (23) of cover (2).

Figure 5:
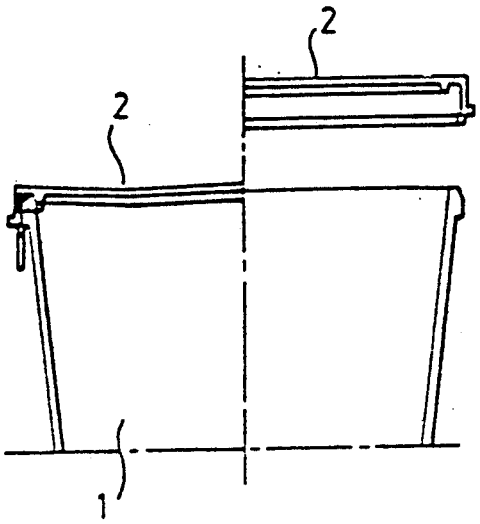
FIG. 5 shows, in its right half, the arrangement of the cover above the receptacle and, in its left part, the mounting of the cover on the receptacle.

FIG. 5 shows, in a diagrammatic manner in the right half and the left half, the relative arrangement of cover (2) and receptacle (1) before and after the insertion.

The more detailed description of the structure of the receptacle and the cover will be made below particularly with the help of FIG. 6.

Figure 6:
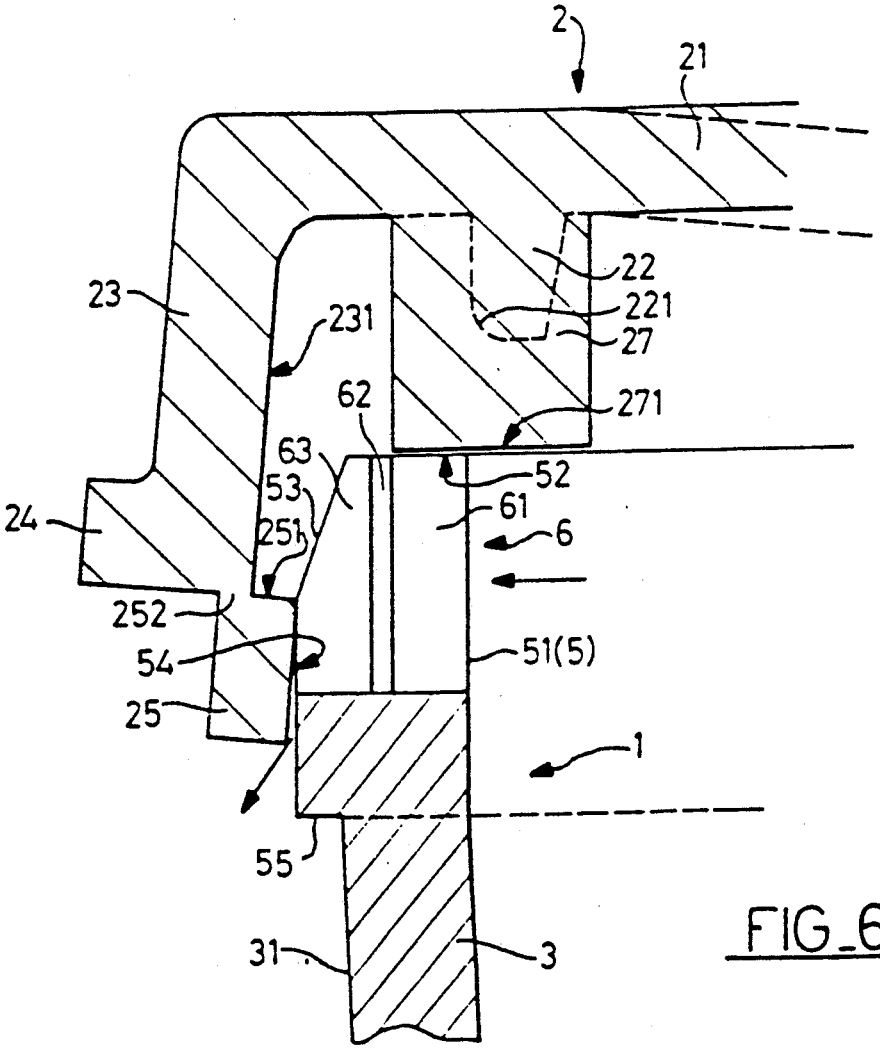
FIG. 6 is a detail view in section on a very enlarged scale of the upper part of the receptacle and the corresponding part of the cover, in a view in section in intermediate closing position.
Figure 7:
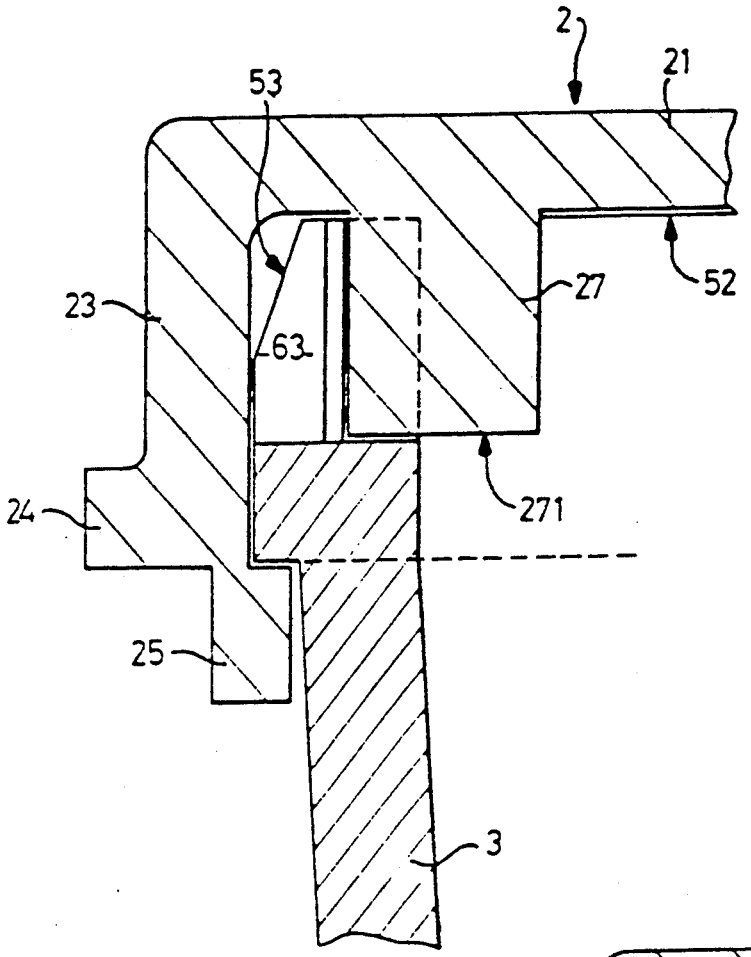
FIG. 7 is a view in section similar to that of FIG. 6 when the box is closed.

Thus, according to FIG. 6, the upper edge of receptacle (1) made by a packing ring (5) has a thickness reinforced relative to side wall (3) of receptacle (1).

This ring (5) comprises a cylindrical inside surface (51), an upper surface (52) located in a horizontal plane, and an outside surface (53) inclined in a truncated cone on the upper part, continued on the lower part by a cylindrical surface (54) in a projection forming a shoulder (55) with outside surface (31) of wall (3) of receptacle (1).

The view in section of FIG. 6 also shows the shape of a passage (6) linking the inside of receptacle (1) with the outside.

Passage (6), which in this embodiment comes out in upper surface (52) of ring (5), consists of a flared inside part (61), continued by a narrow part (62) forming a neck, then an outside part (63) which also can be flared.

In this embodiment, the section of passage (6) is the same over its entire height to facilitate the production by molding and to make possible the mounting of sealing element (27) of cover (2) as will appear below.

Generally, this passage (6) can have the venturi shape as above or even a louver, flap, or valve shape making possible the passage of air or liquid, from inside the receptacle toward the outside.

The height of passage (6) is selected so that it is capped by edge (23) of the cover even when safety strip (25) has been torn.

FIG. 6 also shows, in a detailed manner, the shape of cover (2). The latter consists of a bottom (21) provided on its inside surface with a sealing rib (22) located in a position such that when cover (2) is inserted, it comes behind packing ring (5), against its inside surface (51). This rib has a trapezoidal section with a rounded outside edge to facilitate its mounting behind the packing ring. Completing this sealing rib (22), peripheral, is a sealing element or plug (27) intended, on one hand, to be used as support and, on the other hand, to come into flared inside part (61) to seal it. This sealing element (27) is of cylindrical shape and with a section corresponding, at least for the part concerned, to that of flared inside part (61) of passage (6).

In the embodiment shown, sealing element (27) projects beyond flared part (61) of passage (6) for reasons of strength.

It should be noted that the hatch marks of sealing element (27) of FIG. 6 have been drawn to underline better the shape of this element since in reality, this element resting on the upper surface of ring (5), is not cut by the same cutting plane as that of receptacle (1), cutting passage (6). Actually, in the position shown, passage (6) and the sealing element are offset angularly.

On the outside, cover (2) is provided with an edge (23) forming a skirt of sufficient height to cap packing ring (5).

Figure 8:
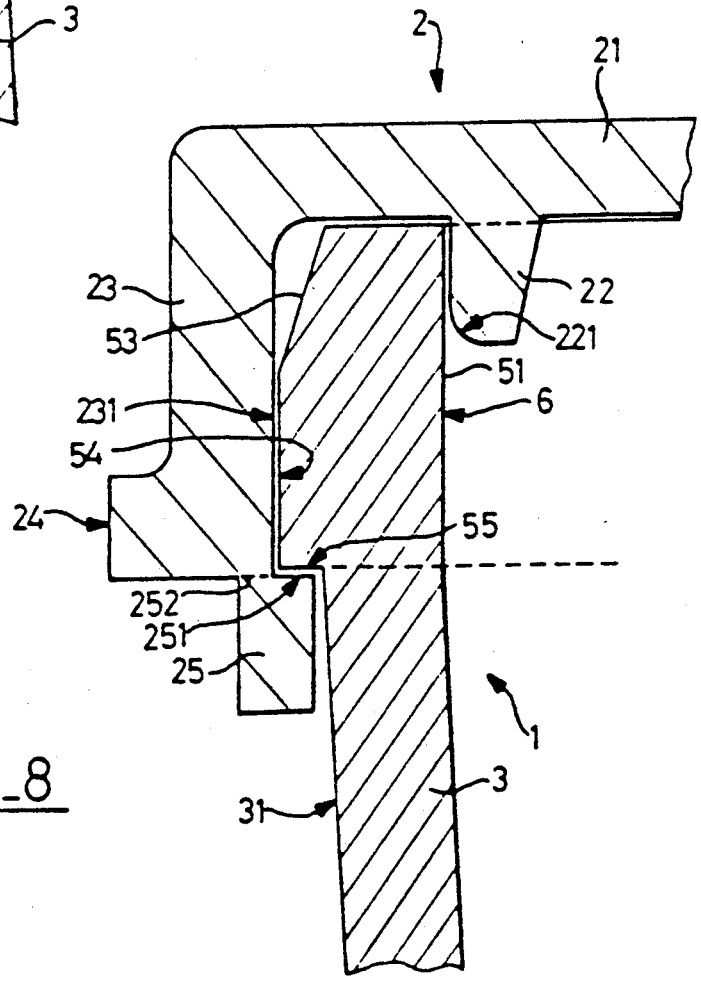
FIG. 8 is a view similar to that of FIG. 7 but cut in a location other than a passage.

Edge (23) is provided in its lower part with a safety ring (25) forming a setback (251) with inside surface (231) of the edge. On the level of this setback (251), there is a breaking line (252) for the tearing of safety strip (25). The height of edge (23) and the size of setback (251) are selected so that this unit can tightly cap packing ring (5), as this appears in FIGS. 8 and 9.

Finally, the number of passages (6) made in packing ring (5) and the number of sealing elements (27) depend on the characteristics of the packaging box, on the nature of the packaged products and on the size of the amounts of air or liquid that it is necessary to expel from it when the box is closed.

Further, since sealing elements (27) are used as support to deform bottom (21) of cover (2), to expel the air and/or the liquid, it is necessary not only that these elements be strong enough but that they also be distributed regularly. Since their number is identical to that of the passages in which they lie, it is advantageous to have at least three units of passages (6)/sealing elements (27).

Generally, the closing of the box consists in placing cover (2) in a partial sealing position, then expelling the air and/or the liquid, then completely closing the box by putting into place safety strip (25).

The various operations will be described below, in a detailed manner, by referring again to FIGS. 6 to 9.

During the first phase (FIG. 6), cover (2) is mounted by engaging it above packing ring (5), thanks to conical surface (53) above which safety strip (25) and inside surface (231) of edge (23) can slide easily.

By this operation, passages (6) and sealing elements (27) are in a position slightly offset angularly so that lower surface (271) of elements (27) comes to rest against upper surface (52) of ring (5) and limits the inserting movement. Passages (6) thus remain disengaged to the rear, and edge (23) or safety strip (25) no longer seal passages (6).

In resting on bottom (21), as is indicated in dots, the air and/or the liquid is expelled through passages (6). At the end of this operation, cover (2) is rotated relative to receptacle (1) to put sealing elements (27) to the right of flared parts (61) of passages (6), then cover (2) is inserted completely so that safety strip (25) comes under shoulder (55) of ring (5) and locks cover (2) in position. Cover (2) then occupies the position shown in FIGS. 7 and 8. The two views in section, one made to the right of a passage (6) and the other in a different location, show, on one hand, the tight placing of edge (23) of cover (2) on ring (5), rib (22) coming from the other side and, on the other hand, the tight placing of sealing element (27) in flared part (61) of passage (6).

The packaging boxes described above can be made in various shapes and capacities, either single or multiple. They can be used in packaging industrial or food products and particularly fragile produce such as caviar, which should be packaged safe from air.

It also should be noted that after the first opening of the cover and tearing of the safety strip, and removal of the cover, the latter can be placed on the receptacle again to close it in a sealed manner with expulsion of the air, by proceeding as has been described above, whether the box is full to the brim or only partially full.

I claim:

1. A sealed packaging box comprising:

a receptacle having an opening;

a reinforced packing ring bordering the opening;

at least one flared passage penetrating the packing ring and connecting an inside of the receptacle with an outside of the receptacle through an outside orifice, the passage being flared toward the inside of the receptacle;

a cover adapted to close the box in a sealed manner, said cover having a bottom, an annular rib projecting from the bottom for mating with an inside surface of the packing ring, a peripheral outside edge for coming over a corresponding edge of the packing ring to mate with an outside surface of the packing ring, said peripheral outside edge also capping the outside orifice of the flared passage; and a sealing element corresponding to said at least one flared passage, said sealing element arranged so as to come into the flared passage and seal it at least partially when the cover is mounted on the receptacle.

2. The packaging box according to claim 1, further comprising a safety strip connected to the peripheral outside edge by a preferred breaking line, said safety strip being adapted to hook under an edge provided on an external wall of the receptacle.

3. The packaging box according to claim 1, wherein the outside orifice of the flared passage is formed through an upper edge of the receptacle.

4. The packaging box according to claim 1, wherein the flared passage is formed by an inside flared part and an outside flared part separated by a neck.

5. The packaging box according to claim 4, wherein the inside flared part has a V-shaped section and wherein the corresponding sealing element of the cover has a diamond-shaped section.

6. The packaging box according to claim 1, wherein the cover comprises a reinforcing and lifting rib.

7. The packaging box according to claim 1, wherein an outside upper part of the packing ring is formed by a conical surface to facilitate mounting of the cover.

8. The packaging box according to claim 1, wherein the annular rib of the cover has a rounded edge for facilitating mating with the packing ring.

* * * * *